US010016980B2

(12) United States Patent
Arai

(10) Patent No.: US 10,016,980 B2
(45) Date of Patent: Jul. 10, 2018

(54) INKJET PRINTING APPARATUS

(71) Applicant: BROTHER KOGYO KABUSHIKI KAISHA, Nagoya-shi, Aichi-ken (JP)

(72) Inventor: Yusuke Arai, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/416,804

(22) Filed: Jan. 26, 2017

(65) Prior Publication Data

US 2017/0217186 A1 Aug. 3, 2017

(30) Foreign Application Priority Data

Jan. 29, 2016 (JP) ..... 2016-016739

(51) Int. Cl.
*B41J 2/16* (2006.01)
*B41J 2/165* (2006.01)

(52) U.S. Cl.
CPC ..... *B41J 2/16505* (2013.01)

(58) Field of Classification Search
CPC ..... B41J 2/16505; B41J 2/16514; B41J 2/16517; B41J 2/1707; B41J 11/001; B41J 11/0025; B41J 11/0035
See application file for complete search history.

(56) References Cited

U.S. PATENT DOCUMENTS

2005/0151772 A1* 7/2005 Oishi ..... B41J 11/0025 347/16
2007/0134969 A1 6/2007 Endo et al.
2009/0085856 A1 4/2009 Shindo et al.
2009/0085956 A1 4/2009 Shindo et al.
2012/0162302 A1* 6/2012 Oguchi ..... B41J 2/175 347/16

(Continued)

FOREIGN PATENT DOCUMENTS

JP 2000-141822 A 5/2000
JP 2002-73300 A 3/2002

(Continued)

OTHER PUBLICATIONS

Related U.S. Appl. No. 15/417,730, filed Jan. 27, 2017.

(Continued)

*Primary Examiner* — Patrick King
(74) *Attorney, Agent, or Firm* — Merchant & Gould P.C.

(57) ABSTRACT

A controller of an inkjet printing apparatus is configured such that, in response to receipt of a preceding command, which notifies transmission of a recording command in advance, from an information processing device through the communication device, the controller executes a separating process to move from a covering position to a spaced position, a moving process to move a carriage, from which the cap is separated, from a first position to a second position, a flushing process to cause the inkjet head to eject the ink toward an ink receiver in response to receipt of a recording command instructing recording of an image on the sheet and upon completion of the moving process, and a recording process to cause a conveyer to convey the sheet and cause the inkjet head to eject the ink in accordance with the recording command, in response to completion of the flushing process.

12 Claims, 10 Drawing Sheets

(56) References Cited

U.S. PATENT DOCUMENTS

| | | | | |
|---|---|---|---|---|
| 2012/0223981 | A1* | 9/2012 | Koike | B41J 2/175 347/6 |
| 2012/0327150 | A1 | 12/2012 | Takagi | |
| 2014/0184675 | A1* | 7/2014 | Tamaki | B41J 2/14233 347/9 |
| 2015/0091976 | A1* | 4/2015 | Mizutani | B41J 2/16508 347/23 |
| 2017/0217187 | A1* | 8/2017 | Yamada | B41J 2/16505 |
| 2017/0217188 | A1 | 8/2017 | Mori | |

FOREIGN PATENT DOCUMENTS

| | | | |
|---|---|---|---|
| JP | 2007-125823 | A | 5/2007 |
| JP | 2008-37006 | A | 2/2008 |
| JP | 2013-6363 | A | 1/2013 |

OTHER PUBLICATIONS

U.S. Office Action issued in related U.S. Appl. No. 15/417,730, dated Oct. 20, 2017.
U.S. Office Action (Notice of Allowance) issued in related U.S. Appl. No. 15/417,730, dated May 2, 2018.

* cited by examiner

INKJET PRINTING APPARATUS

CROSS-REFERENCE TO RELATED APPLICATIONS

This application claims priority under 35 U.S.C. § 119 from Japanese Patent Application No. 2016-016739 filed on Jan. 29, 2016. The entire subject matter of the application is incorporated herein by reference.

BACKGROUND

Technical Field

The present disclosures relate to an inkjet printing apparatus which is configured to print an image on a sheet in accordance with a recording command received from an information processing device through a communication network.

Related Art

Conventionally, in a system including the information processing apparatus and a printer which are connected through a communication network, an attempt has been made to shorten an FPOT (first paper output time), which represents a time period from an instruction causing an external device to execute printing is input to the external device to a time at which a first sheet on which an image is formed by the external device has been discharged.

Conventionally, there has been known a recording device, which is configured to start a recording preparation operation in response to receipt of a recording preparation instruction from an information processing device, and starts a recording operation in response to completion of receipt of the recording data from the information processing device and completion of the recording preparation operation. In the above-mentioned publications, it is described that, by employing the above configuration, a time period from receipt of the recording data to start of the recording operation can be shortened.

SUMMARY

The recording preparation operation as mentioned above typically includes an operation to release a cap from an inkjet head, an operation to cause the inkjet head to execute preparatory ejection of ink, an operation to move the inkjet head to a position in the vicinity of an image recording area, an operation to convey a recording sheet, and the like. If, for example, a time period from execution of the preparatory ejection operation to start of the recording operation becomes longer, there may occur a problem that the ink is dried inside the inkjet head and an image recordation quality may be deteriorated. That is, in the above-described conventional configuration, the preparatory operation includes an operation which is preferably completed immediately before the start of the recording operation.

According to aspects of the disclosures, there is provide an improved inkjet recording device in which multiple preparatory operations, which should be executed before an image recordation is started, are executed at appropriate timings, respectively.

According to aspects of the disclosures, there is provided an inkjet printing apparatus, which has a sheet conveyer configured to convey a sheet in a conveying direction, a carriage configured to move in a main scanning direction which intersect with the conveying direction in an area including a sheet facing area within which the carriage faces the sheet conveyed by the sheet conveyer, an inkjet head mounted on the carriage and configured to eject ink droplets through nozzles formed on the inkjet head, a cap configured to face the inkjet head when the carriage is located at a first position which is outside the sheet facing area in the main scanning direction, the cap being movable between a covering position and a spaced position, the covering position being a position at which the cap closely contacts the inkjet head and covers the nozzles, the spaced position being a position at which the cap is spaced from the inkjet head, an ink receiver configured to face the inkjet head when the ink receiver is located at a second position which is outside the sheet facing area in the main scanning direction and different from the first position, a communication device, and a controller. In response to receipt of a preceding command, which is a command notifying transmission of a recording command in advance, from an information processing device through the communication device, the controller is configured to execute a separating process to move the cap from the covering position to the spaced position, a moving process to move the carriage from which the cap is spaced from the first position to the second position, a flushing process to cause the inkjet head to eject the ink toward the ink receiver in response to receipt of the recording command which instructs recording of an image on the sheet through the communication device and upon completion of the moving process, and a recording process to cause the conveyer to convey the sheet and cause the inkjet head to eject the ink in accordance with the recording command, in response to completion of the flushing process.

According to aspects of the disclosures, there is provided an inkjet printing apparatus, which includes a sheet conveyer configured to convey a sheet in a conveying direction, a carriage configured to move in a main scanning direction which intersect with the conveying direction in an area including a sheet facing area within which the carriage faces the sheet conveyed by the sheet conveyer, an inkjet head mounted on the carriage and configured to eject ink droplets through nozzles formed on the inkjet head, a cap configured to face the inkjet head when the carriage is located at a first position which is outside the sheet facing area in the main scanning direction, the cap being movable between a covering position and a spaced position, the covering position being a position at which the cap closely contacts the inkjet head and covers the nozzles, the spaced position being a position at which the cap is spaced from the inkjet head, an ink receiver configured to face the inkjet head when the ink receiver is located at a second position which is outside the sheet facing area in the main scanning direction and different from the first position, a communication device, and a controller. In response to receipt of a preceding command which is a command notifying transmission of a recording command in advance from an information processing device through the communication device, the controller is configured to separate the cap from the covering position to the spaced position, move the carriage from which the cap is spaced from the first position to the second position, cause the inkjet head to eject the ink toward the ink receiver in response to receipt of the recording command which instructs recording of an image on the sheet through the communication device and upon completion of movement of the carriage, and cause the conveyer to convey the sheet and cause the inkjet head to eject the ink in accordance with the recording command, in response to completion of casing the inkjet head to eject the ink toward the ink receiver.

BRIEF DESCRIPTION OF ACCOMPANYING DRAWINGS

Figure 4:
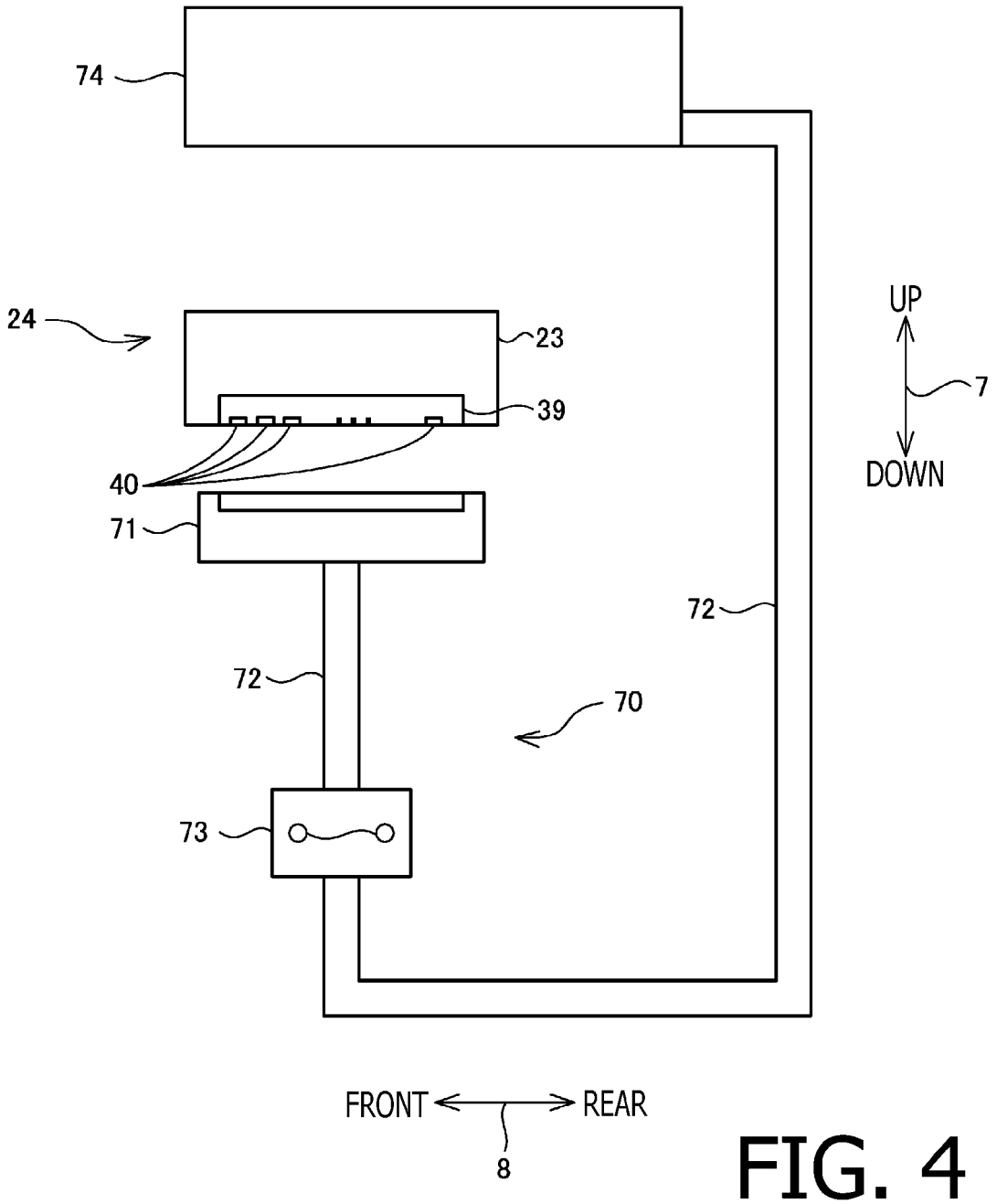

FIG. 4 schematically shows a configuration of a maintenance device of the printer of the MFP according to the illustrative embodiment of the disclosures.

Figure 5A:
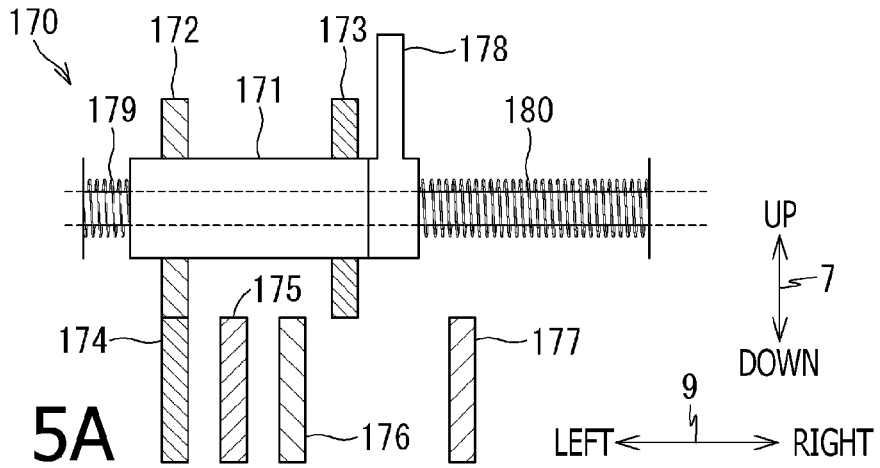

FIG. 5A schematically shows a switching mechanism at a first state according to the illustrative embodiment of the disclosures.

Figure 5B:
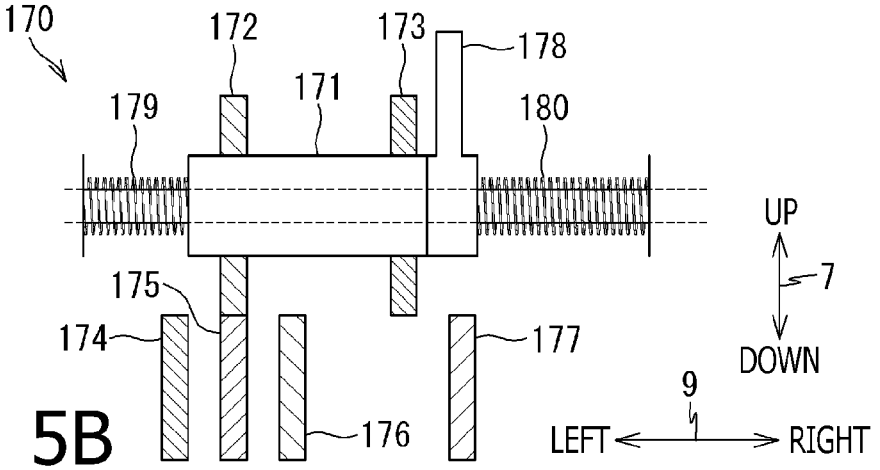

FIG. 5B schematically shows the switching mechanism at a second state according to the illustrative embodiment of the disclosures.

Figure 5C:
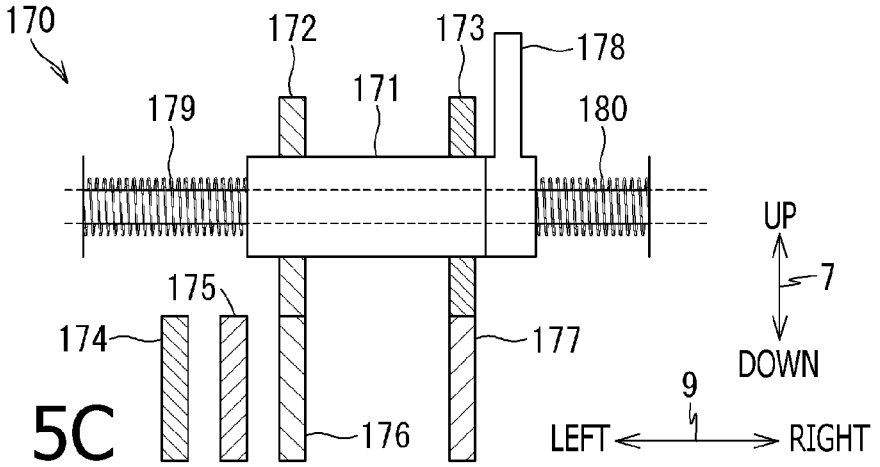

FIG. 5C schematically shows the switching mechanism at a third state according to the illustrative embodiment of the disclosures.

Figure 6:
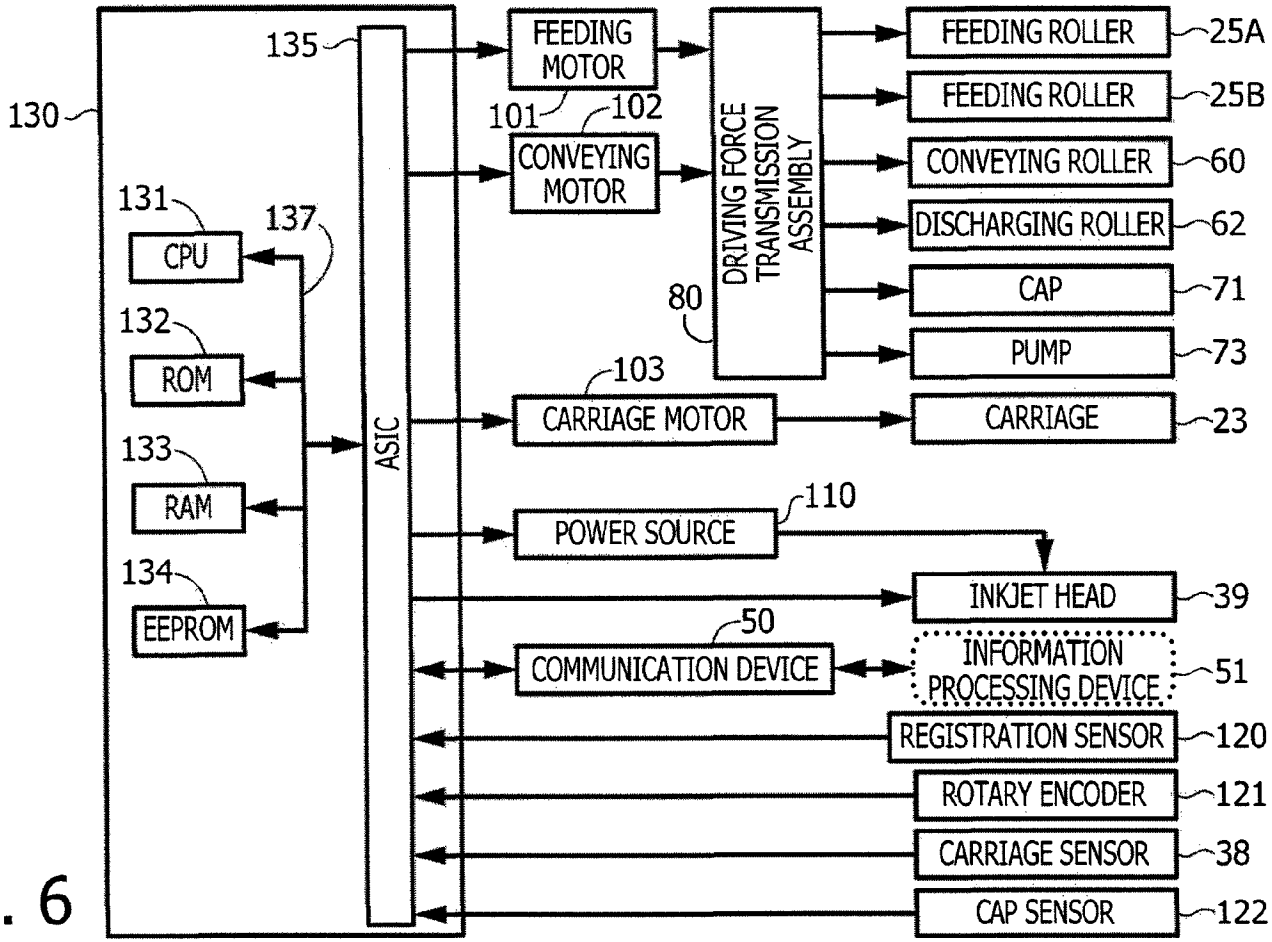

FIG. 6 is a block diagram showing a configuration of the MFP according to the illustrative embodiment of the disclosures.

Figure 7:
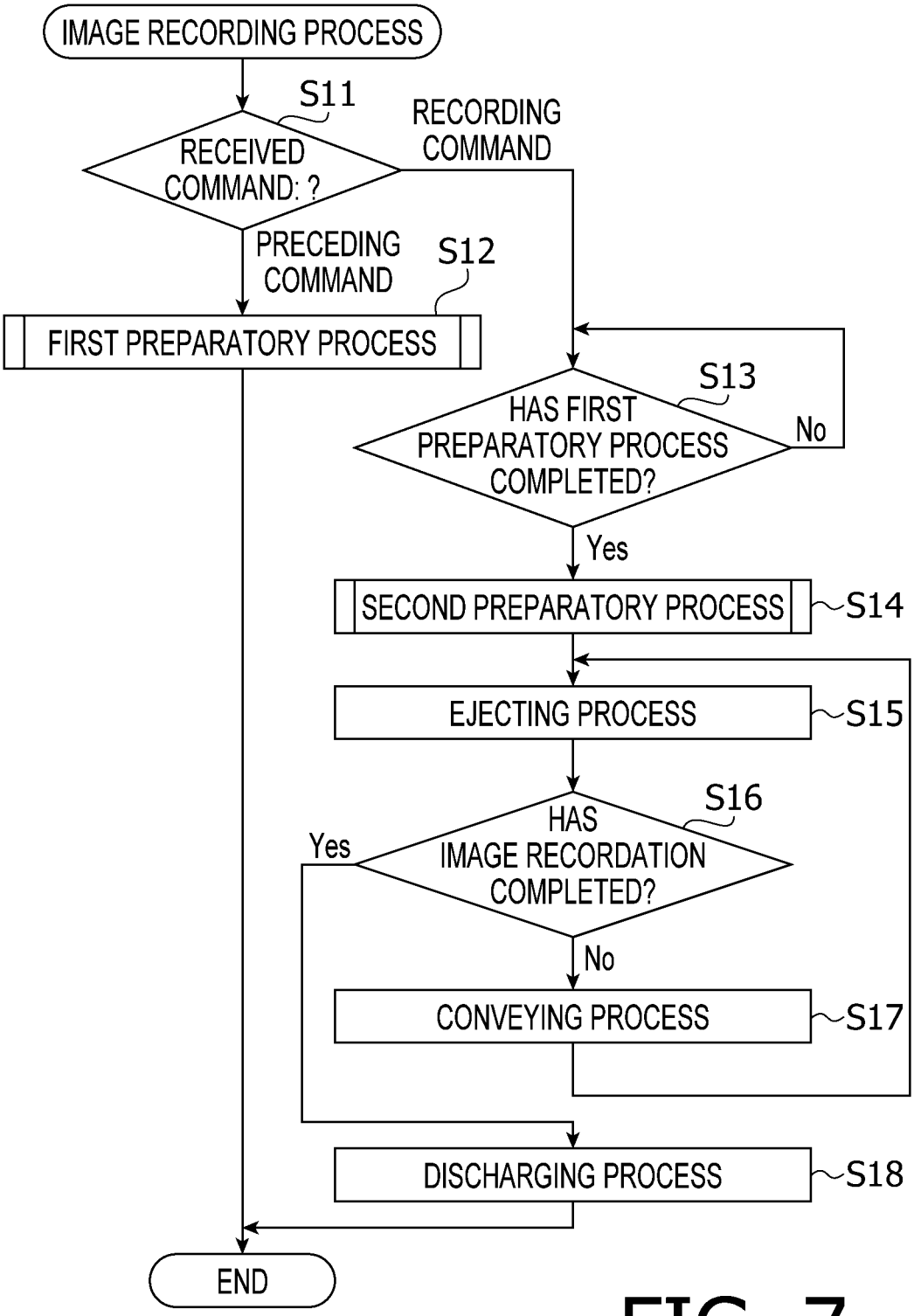

FIG. 7 is a flowchart illustrating an image forming process according to the illustrative embodiment of the disclosures.

Figure 8:
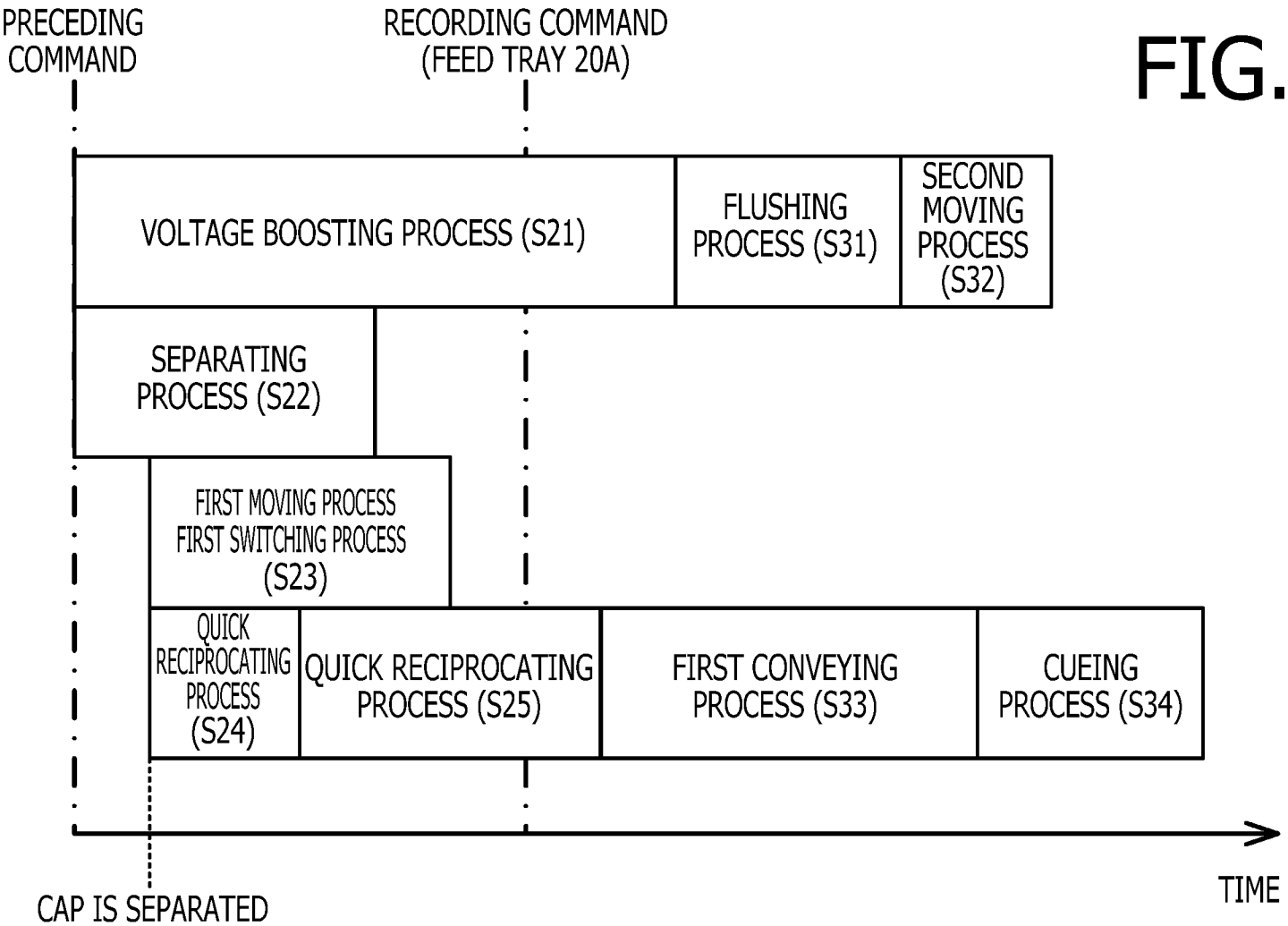

FIG. 8 is a timing chart showing execution timings of a first preparatory process and a second preparatory process when a recording command indicating usage of a first feed tray before completion of the first preparatory process.

Figure 9:
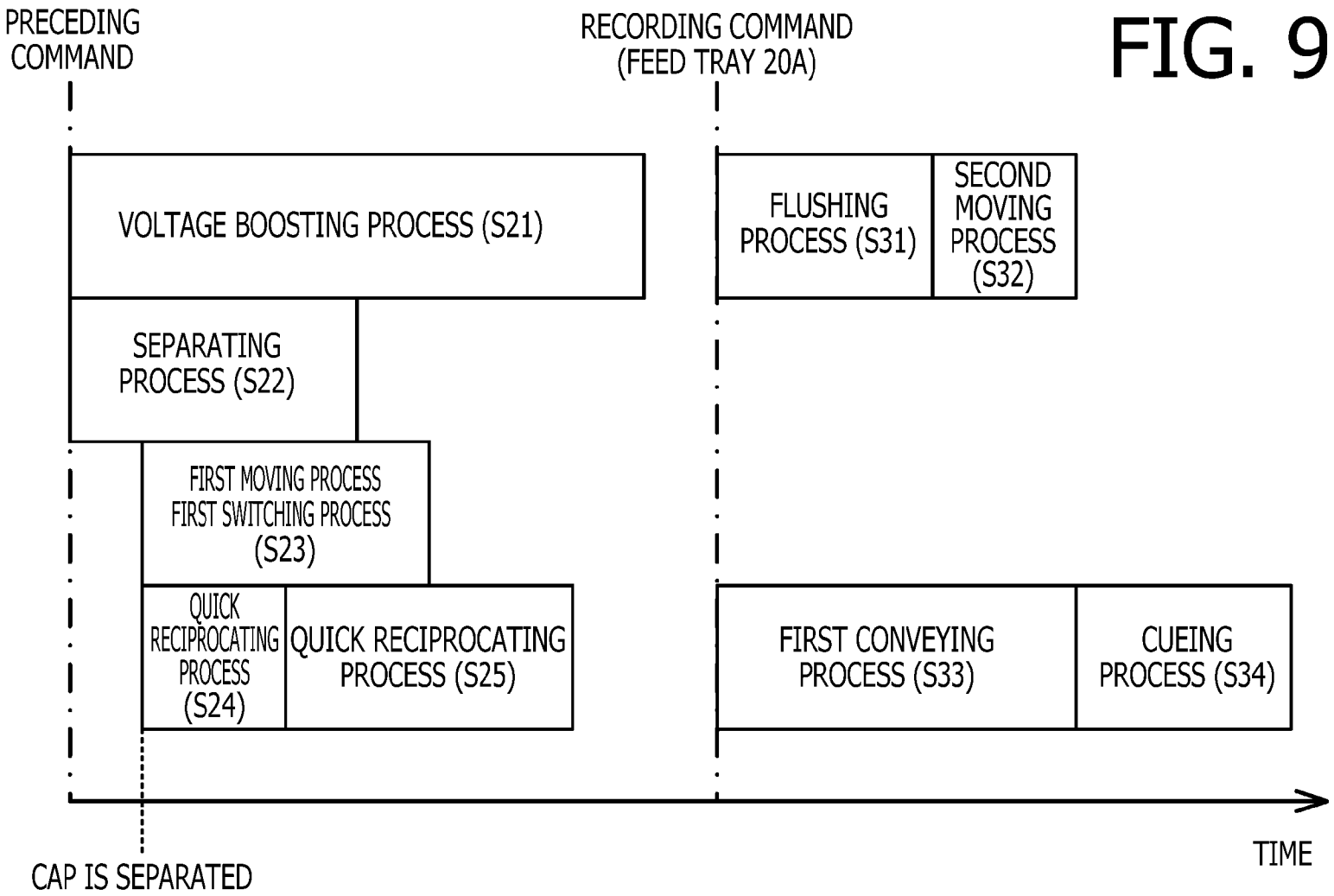

FIG. 9 is a timing chart showing execution timings of the first preparatory process and the second preparatory process when the recording command indicating usage of the first feed tray after completion of the first preparatory process.

Figure 10:
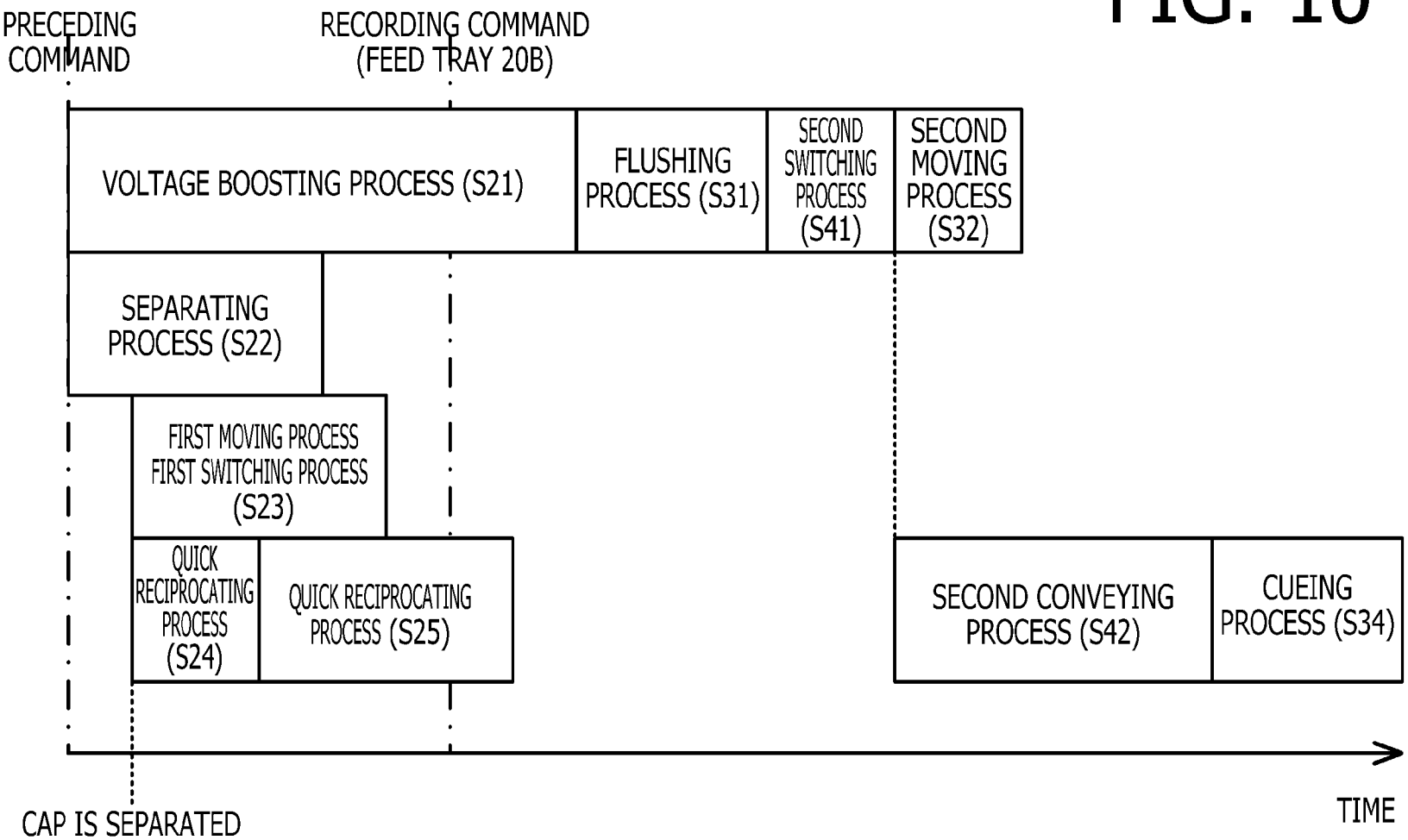

FIG. 10 is a timing chart showing execution timings of the first preparatory process and the second preparatory process when a recording command indicating usage of a second feed tray before completion of the first preparatory process.

DETAILED DESCRIPTION OF ILLUSTRATIVE EMBODIMENT

Figure 1:
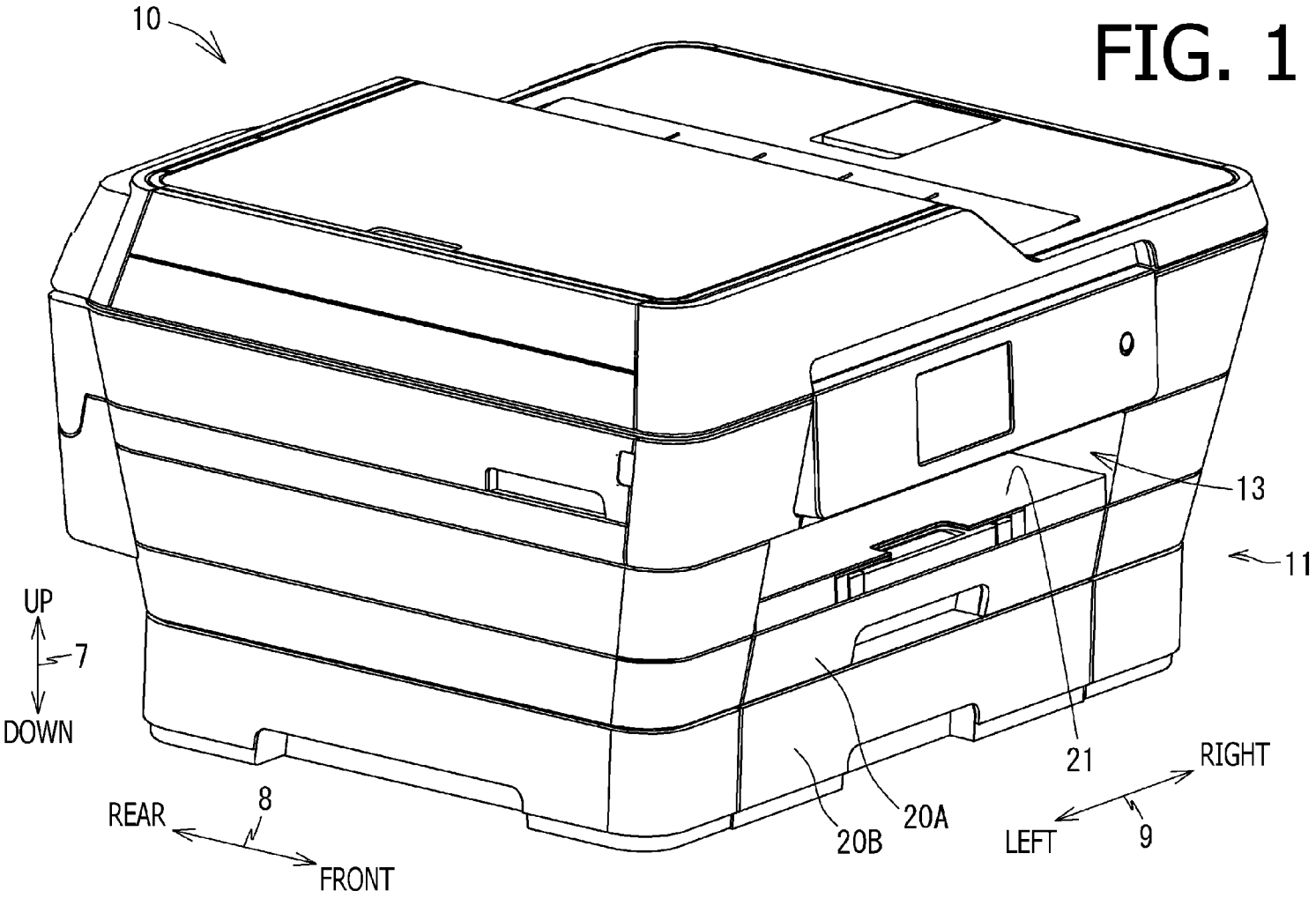
FIG. 1 is a perspective view of an MFP (multi-function peripheral) according to an illustrative embodiment of the disclosures.

Hereinafter, an illustrative embodiment according to the disclosures will be described, referring to the accompanying drawings. It is noted that the illustrative embodiment described below is only one example according to the disclosures, and may be modified in various ways without departing from the aspects of the disclosures. In the following description, a term "direction" will be used to express a direction directed from a start point of an arrow toward an end point of the arrow, or a direction (regardless of its orientation) parallel to a line segment connecting the start point and the end point of the arrow. The former may also be expressed as an "orientation direction" in order to stress that the orientation should also be considered. Further, an up-down direction 7 is defined based on a state where an MFP (multi-function peripheral) 10 is placed for used (e.g., a state shown in FIG. 1). In the state as shown in FIG. 1, a front-rear side 8 is also defined such that a side where an opening 13 is formed is a front side. Further, a right-left side 9 is defined when the MFP 10 is viewed from the front side thereof.

<Overall Configuration of MFP>

The MFP 10 according to the illustrative embodiment has a substantially rectangular parallelepiped shape as shown in FIG. 1. The MFP 10 has a printer 11. Further, the MFP 10 may have a scanner configured to read an image formed on an original and generate image data. It is noted that the MFP 10 is an example of an inkjet printing apparatus.

<Printer>

Figure 2:
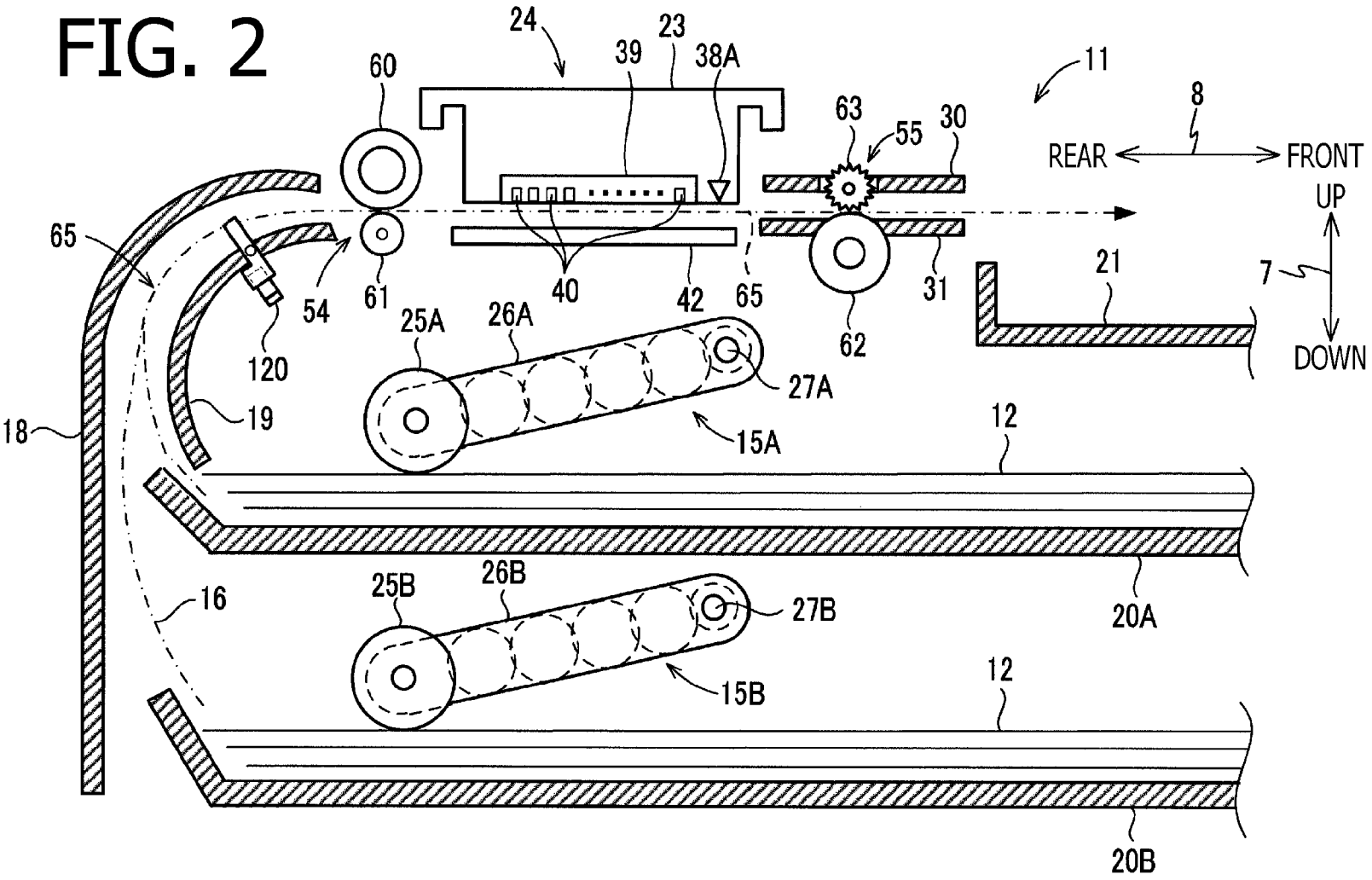
FIG. 2 is a cross-sectional side view of a printer of the MFP schematically showing an inside configuration thereof according to the illustrative embodiment of the disclosures.

The printer 11 employs a so-called inkjet printing method and is configured to execute a printing operation to print images represented by image data on the sheets 12 (see FIG. 2) by ejecting ink droplets thereon. As shown in FIG. 2, the printer 11 has feeder assemblies 15A and 15B, feed trays 20A and 20B, a discharge tray 21, a conveying roller assembly 54, a printer assembly 24, a discharge roller assembly 55, and a platen 42. It is noted that the conveying roller assembly 54 and the discharge roller assembly 55 are examples of conveying assembly.

<Feed Trays and Discharge Tray>

On a front side of the printer 11, an opening 13 (see FIG. 1) is formed. The first and second feed trays 20A and 20B are configured to be inserted in/withdrawn from the printer 11 in the front-rear direction 8 through the opening 13. Each of the first and second feed trays 20A and 20B is configured to support multiple sheets 12 in a stacked manner. The discharge tray 21 is configured to catch and support the sheets 12 discharged, by a discharge roller assembly 55, from the printer 11 through the opening 13. It is noted that the first feed tray 20A is an example of a first tray, and the second feed tray is an example of a second tray.

<Feeder Assemblies>

The feeder assembly 15A has a feeding roller 25A, a feeder arm 26A and a shaft 27A. The feeding roller 25A is rotatably supported at a distal end part of the feeder arm 26A. The feeder arm 26A is rotatably supported by the shaft 27A, which is supported by a frame of the printer 11. The feeder arm 26A is urged such that the feeding roller 25A is urged toward the first feed tray 20A by its own weight or an elastic force using an elastic member such as a spring. The feeder assembly 15B has a feeding roller 25B, a feeder arm 26B and a shaft 27B. The feeding roller 25B is rotatably supported at a distal end part of the feeder arm 26B. The detailed configuration of the feeder assembly 15B is the same as that of the feeder assembly 15A.

As the feeding motor 101 rotates forwardly and the feeding roller 25A is driven to rotate, the feeder assembly 15A feeds the sheet 12 supported by the first feed tray 20 to a conveying passage 65. As the feeding motor 101 rotates forwardly and the feeding roller 25B is driven to rotate, the feeder assembly 15A feeds the sheet 12 supported by the first feed tray 20A to the conveying passage 65.

<Sheet Conveying Passage>

A sheet conveying passage 65 is a space defined by guide members 18, 19, 30 and 31. The guide members 18 and 19 face each other, inside the printer 11, with a particular clearance therebetween, and the guide members 30 and 31 face each other, inside the printer 11, with a particular clearance therebetween. The sheet conveying passage 65 is a passage extending upward from a rear end of the feed tray 20, making a U-turn at an upper-rear part of the printer 11, and then extending frontward to reach the discharge tray 21. It is noted that a conveying direction 16 of the sheet 12 in the sheet conveying passage 65 is indicated with an arrowed one-dot line in FIG. 2.

<Conveying Roller Assembly>

The conveying roller assembly 54 is arranged on an upstream in the conveying direction 16 with respect to the printer assembly 24. The conveying roller assembly 54 has a conveying roller 60 and a pinch roller 61, which face each other. The conveying roller 60 is driven by the conveying motor 102 to rotate. The pinch roller 61 is driven to rotate in association with rotation of the conveying roller 60. The sheet 12 is nipped by the conveying roller 60 and the pinch roller 61, and conveyed along the conveying direction 16 as the conveying motor 102 rotates forwardly and the conveying roller 60 rotates forwardly in association with the forward rotation of the conveying motor 102. It is noted that the conveying roller 60 is configured to rotate reversely in association with a reverse rotation of the conveying motor 102, which is opposite to the forward rotation of the conveying motor 102.

<Discharge Roller Assembly>

A discharge roller assembly 55 is arranged on a downstream, in the conveying direction 16, with respect to the printer assembly 24. The discharge roller assembly 55 has a discharging roller 62 and a spur roller 63. The discharging roller 62 is driven by the conveying motor 102 to rotate. The spur roller 63 rotates in association with rotation of the discharging roller 62. The sheet 12 is nipped by the discharging roller 62 and the spur roller 63, and conveyed along the conveying direction 16 as the conveying motor 102 rotate forwardly and the discharge roller 62 rotates forwardly in association with the forward rotation of the conveying motor 102.

<Registration Sensor>

The printer 11 has a registration sensor 120 (see FIG. 2). The registration sensor 120 is arranged on an upstream, in the conveying direction 16, with respect to the conveying roller assembly 54. The registration sensor 120 is configured to output different detection signals depending on whether the sheet 12 is present or absent at the position where the registration sensor 120 is arranged. Specifically, the registration sensor 120 transmits a high-level signal to a controller 130 (see FIG. 6) in response to detection of presence of the sheet 12 at the arranged position, while transmits a low-level signal to the controller 130 in response to detection of absence of the sheet at the arranged position.

<Rotary Encoder>

The printer 11 has a rotary encoder 121 (see FIG. 6) which is configured to output a pulse signal in accordance with rotation of the conveying roller 60 (in other words, in response to rotation of the conveying motor 102). The rotary encoder 121 is of a well-known type and has an encoder disc and an optical sensor. The encoder disc is configured to rotate in association with a rotation of the conveying roller 60. The optical sensor is configured to read the encoder disc to generate the pulse signal, and transmits the thus generated pulse signal to the controller 130.

<Printer Assembly>

Figure 3:
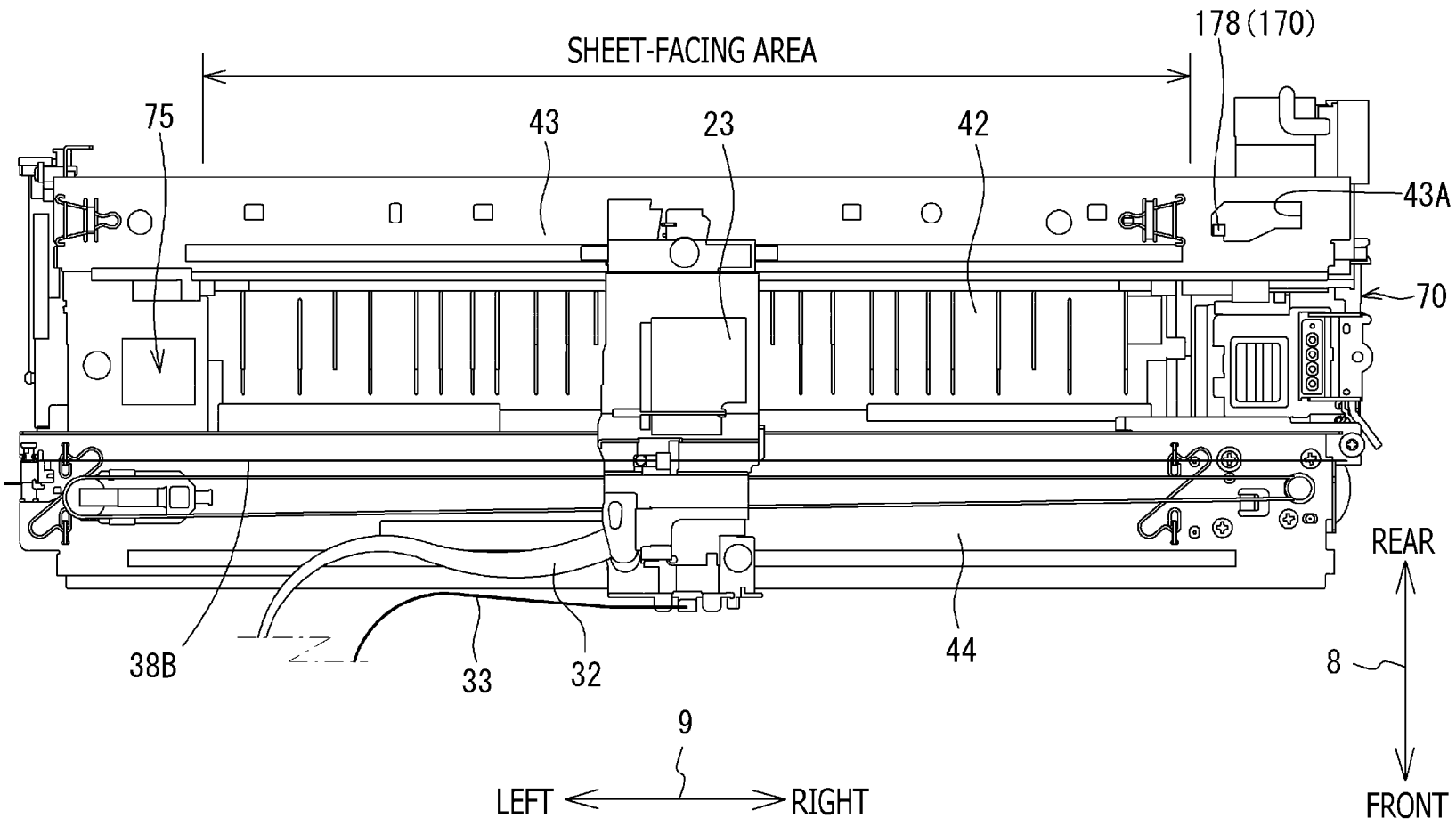
FIG. 3 is a plan view of a carriage and guide rails of the printer of the MFP according to the illustrative embodiment of the disclosures.

The printer assembly 24 is arranged between, in the conveying direction 16, the conveying roller assembly 54 and the discharge roller assembly 55 as shown in FIG. 2. Further, the printer assembly 24 is arranged to face, in the up-down direction, the platen 42. The printer assembly 24 is provided with a carriage 23, the inkjet head 39 and an encoder sensor 38A. Further, to the carriage 23, an ink tube 32 and a flexible flat cable 33 are connected as shown in FIG. 3. The ink tube 32 serves to supply ink of the ink cartridge to the inkjet head 39. The flexible flat cable 33 serves to electrically connect a control circuit board implemented in the controller 130 with the inkjet head 39.

The carriage 23 is slidably supported by guide rails 43 and 44, which are arranged to be spaced in the front-read direction 8 and each of which extends in the right-left direction 9 as shown in FIG. 3. The carriage 23 is connected to a well-known belt-driving mechanism associated with the guide rail 44. The belt-driving mechanism is driven by a carriage motor 103 (see FIG. 6). That is, the carriage 23 is connected to a belt of the belt-driving mechanism, which belt is driven to circumferentially move by the carriage motor 103, thereby the carriage 23 being reciprocally moved in the right-left direction 9. It should be noted that right-left direction is an example of a main scanning direction.

The inkjet head 39 is mounted on the carriage 23 as shown in FIG. 2. On a bottom surface of the inkjet head 39, multiple nozzles 40 are formed. The inkjet head 39 ejects ink droplets through the multiple nozzles 40. Specifically, while the carriage 23 is moving, the inkjet head 39 ejects the ink droplets to the sheet 12 supported by the platen 42, thereby an image is formed on the sheet 12.

A belt-like encoder strip 38, which extends in the right-left direction, is attached to the guide rail 44 (see FIG. 3). The encoder sensor 38A is mounted on the bottom surface of the carriage 23 at a position where the encoder sensor 38A faces the encoder strip 38B. As the carriage 23 moves, the encoder sensor 38A reads the encoder strip 38B and generates a pulse signal, and transmits the thus generated pulse signal to the controller 130. It is noted that the encoder sensor 38A and the encoder strip 38B constitute a carriage sensor 38 (see FIG. 6).

<Platen>

The platen 42 is arranged between, in the conveying direction 16, the conveying roller assembly 54 and the discharge roller assembly 55 as shown in FIG. 2. Further, the platen 42 is arranged to face, in the up-down direction, the printer assembly 24. The platen 42 is configured to support the sheet 12, which is conveyed by at least one of the conveying roller assembly 54 and the discharge roller assembly 55, from below.

<Maintenance Device>

The printer 11 has a maintenance device 70 as shown in FIG. 3. The maintenance device 70 is used for maintenance of the inkjet head 39. Specifically, the maintenance device 70 executes a purge operation to suck the ink and/or air inside the nozzles 40 and foreign substances adhered onto a nozzle surface. It is noted that the nozzle surface is a surface of the inkjet head 39 on which the nozzles 40 are formed. In the following description, the ink and/or air inside the nozzles 40 and the foreign substances adhered onto the nozzle surface will be simply referred to as "ink and the like" for brevity. The sucked/removed ink and the like by the maintenance device 70 is stored in a waste-liquid tank 74 (see FIG. 4).

As shown in FIG. 3, the maintenance device 70 is arranged on an outer side (i.e., the right side in the illustrative embodiment) with respect to a sheet facing area. The sheet facing area is an area, in the main scanning direction, within which the sheet 12 conveyed by the conveying assembly 54 can face the carriage 23. The maintenance device 70 has a cap 71, a tube 72 and a pump 73 (see FIG. 4).

The cap 71 is made of rubber. The cap 71 is arranged such that, when the cap 71 is located on the right side (along the main scanning direction) with respect to the sheet facing area, the cap 71 face the inkjet head 39 of the carriage 23. The tube 72 extends from the cap 71 to the waste-liquid tank 74 via the pump 73. The pump 73 is, for example, a rotary type tube pump. The pump 73 is driven by the conveying motor 102 to operate to suck the ink and the like in the nozzles 40 through the cap 71 and the tube 72, and discharge the same in the waste-liquid tank 74 though the tube 72.

The cap 71 is configured to be movable between a covering position and a spaced position which are spaced in the up-down direction 7. When located at the covering position, the cap 71 closely contacts the inkjet head 39 of the carriage 23 located at the first position to cover the nozzle surface thereof. When located at the spaced position, the cap 71 is spaced from the nozzle surface. The cap 71 is configured to move between the covering position and the spaced position with a lifting device (not-shown) which is driven by the feeding motor 101.

<Cap Sensor>

A cap sensor 122 is configured to output different signals depending on whether the cap 71 is located at the covering position or not. According to the illustrative embodiment, the cap sensor 122 transmits a high level signal to a controller 130 in response to the cap 71 being located at the covering position, while the cap sensor 122 transmits a low level signal to the controller 130 in response to the cap 71 being located at a position other than the covering position. Accordingly, when the cap 71 moves from the covering position to the spaced position, the detection signal output by the cap sensor 122 changes from the high signal to the low level signal before the cap 71 reaches the spaced position.

<Ink Receiver>

The printer 11 has an ink receiver 75 (see FIG. 3). The ink receiver 75 is arranged at a position on the other side (i.e., left side), in the main scanning direction, with respect to the sheet facing area. According to the illustrative embodiment, the ink receiver 75 is arranged such that, when the carriage 23 is located at a second position which is a position on the left side, in the main scanning direction, with respect to the sheet facing area, the ink receiver 75 faces the inkjet head 39 of the carriage 23. It is noted that the maintenance mechanism and the ink receiver may be arranged on the same side, in the main scanning direction, with respect to the sheet facing area. It is noted, however, the first position and the second position should be spaced in the main scanning direction.

The ink receiver 75 has a substantially rectangular-parallelepiped shape having an opening on an upper surface thereof. Inside the ink receiver 75, an ink absorbing member is accommodated. The ink discharged from the nozzles 40 of the inkjet head 39, when the carriage 23 is located at the second position, toward the opening of the ink receiver 75 is caught by the ink receiver 75 and absorbed by the ink absorbing member inside the ink receiver 75.

<Driving Force Transmission Assembly>

The printer 11 is provide with a driving force transmission assembly 80 (see FIG. 6). The driving force transmission assembly 80 is configured to transmit driving forces of the feeding motor 101 and the conveying motor 102 to the feeding roller 25, the conveying roller 60, the discharging roller 62, the lifting device for the cap 71 and the pump 73. The driving force transmission assembly 80 is configured by combining all or parts of gears, pulleys, an endless annular belt, a planetary gear mechanism (a pendulum gear mechanism), and a one way clutch and the like. Further, the driving force transmission assembly 80 includes a switching mechanism 170 (see FIG. 5) configured to switch destinations of the driving forces of the feeding motor 101 and the conveying motor 102.

<Switching Mechanism>

The switching mechanism 170 is arranged at a position on one side, in the main scanning direction, of the sheet facing area as shown in FIG. 3. Further, the switching mechanism 170 is arranged below the guide rail 43. As shown in FIGS. 5A-5C, the switching mechanism 170 has a sliding member 171, driving gears 172 and 174, driven gears 174, 175, 176 and 177, and sprints 179 and 180 which are examples of urging members. The switching mechanism 171 is configured to be switched to be one of a first state, a second state and a third state.

The first state is a state in which the driving force of the feeding motor 101 is transmitted to the feeding roller 25A, but not to the feeding roller 25B or the lifting mechanism of the cap 71. The second state is a state in which the driving force of the feeding motor 101 is transmitted to the feeding roller 25B, but not to the feeding roller 25A or the lifting device for the cap 71. The third state is a state where the driving force of the feeding motor 101 is transmitted to the lifting device for the cap 71, but not to the feeding roller 25A or the feeding roller 25B. Further, in the first state, the driving force of the conveying motor 102 is transmitted to the conveying roller 60 and the discharging roller 62, but not to the pump 73. The second state is a state in which, the driving force of the conveying motor 102 is transmitted to all of the conveying roller 60, the discharging roller 62 and the pump 73.

The slidable member 171 is a substantially cylindrical member and is supported by the supporting shaft (indicated by broken lines in FIGS. 5A, 5B and 5C) which extends in the right-left direction. The sliding member 171 is configured to be slidable in the right-left direction 9 along the supporting shaft. The sliding member 171 rotatably supports the driving gears 172 and 173, which are configured to be independently rotatable on the outer circumferential surface of the slidable member 171, at different positions in the right-left direction. It is noted that, in the right-left direction, the slidable member 171 moves integrally with the driving gears 172 and 173.

The driving gear 172 rotates as the rotational driving force of the feeding motor 101 is transmitted. It is noted that the driving gear 172 engages with one of the driven gears 174, 175 and 176. Specifically, the driving gear 172 engages with the driven gear 174 when the switching mechanism 170 is in the first state (see FIG. 5A). The driving gear 172 engages with the driven gear 175 when the switching mechanism 170 is in the second state (see FIG. 5B). The driving gear 172 engages with the driven gear 176 when the switching mechanism 170 is in the third state (see FIG. 5C).

The driving gear 173 rotates as the rotational driving force of the conveying motor 102 is transmitted. It is noted that the driving gear 173 disengaged from the driven gear 176 when the switching mechanism 170 is in the first or second state (see FIGS. 5A and 5B), while the driving gear 173 engages with the driven gear 176 when the switching mechanism 170 is in the third state (see FIG. 5C).

The driven gear 174 engages with a gear train that rotates the feeding roller 25A. That is, the rotational driving force of the feeding motor 101 is transmitted to the feeding roller 25A as the driving gear 172 engages with the driven gear 174. Further, the rotational driving force of the feeding motor 101 is not transmitted to the feeding roller 25A when the driving gear 172 is disengaged from the driven gear 174. It is noted that the driven gear 174 is an example of a first driven gear.

The driven gear 175 engages with a gear train that rotates the feeding roller 25B. That is, the rotational driving force of the feeding motor 101 is transmitted to the feeding roller 25B as the driving gear 172 engages with the driven gear 175. Further, the rotational driving force of the feeding motor 101 is not transmitted to the feeding roller 25B when the driving gear 172 is disengaged from the driven gear 175. It is noted that the driven gear 175 is an example of a second driven gear.

The driven gear 176 engages with a gear train which is configured to drive the lifting device for the cap 71. Further, the rotational driving force of the feeding motor 101 is not transmitted to the lifting device for the cap 71 when the driving gear 172 is disengaged from the driven gear 176. It is noted that the driven gear 176 is an example of a third driven gear.

The driven gear 177 engages with a gear train that drives the pump 73. That is, the rotational driving force of the conveying motor 102 is transmitted to the pump 73 as the driving gear 173 engages with the driven gear 177. Further, the rotational driving force of the conveying motor 102 is not transmitted to the pump 73 when the driving gear 173 is disengaged from the driven gear 177. The rotational driving force of the conveying motor 102 is transmitted to the conveying roller 60 and the discharging roller 62 with bypassing the switching mechanism 170. That is, the conveying roller 60 and the discharging roller 62 are driven by the rotational driving force of the conveying motor 102, regardless of the driving state of the switching mechanism 170.

The lever 178 is supported by the supporting shaft at a position, in the right-left direction 9, on the right side of the slidable member 171. Further, the lever 178 is configured to slide in the right-left direction 9, along the supporting shaft. Further, the lever 178 protrudes upward. A tip end of the lever 178 extends through an opening 43A formed on the guide rail 43 and reaches a position at which the tip end of the lever 178 could contact the carriage 23 in the right-left direction 9.

The lever 178 slides in the right-left direction 9 as the carriage 23 contacts with/released from the lever 178. The switching mechanism 170 has multiple engaging parts configured to engage with the lever 178. When engages with one of the engaging parts provided to the switching mechanism 170, the lever 178 stays at the position after the carriage 23 is released from the lever 178.

The springs 179 and 180 are supported by the supporting shaft. The spring 179 is arranged such that one end (i.e., left end) thereof contacts a frame of the printer 11, while the other end (i.e., right end) thereof contacts a left surface of the slidable member 171. That is, the spring 179 urges the slidable member 171 and the lever 177 which contacts and urges the slidable member 171 rightward. The spring 180 is arranged such that one end (i.e., right end) thereof contacts the frame of the printer 11, while the other end (i.e., left end) thereof contacts the right surface of the lever 177. That is, the spring 180 urges the lever 177 and the slidable member 171, which contacts the lever 177, leftward. Further, it is noted that the urging force of the spring 180 is greater than that of the spring 179.

When the lever 178 is engages with a first engaging member, the switching mechanism 170 is in its first state. As the carriage 23 moves rightward, the lever 178 is pushed by the carriage 23 and moves rightward, against an urging force by a spring 180, and engages with a second engaging member which is located on a right side with respect of the first engaging member. Then, the slide member 171 moves rightward, against the urging force of a sprint 179 and following the rightward movement of the lever 178. As a result, the state of the switching mechanism 170 changes from the first state (see FIG. 5A) to a second state (see FIG. 5B). That is, the lever 178 contacts the carriage 23 moving from the second position to the first position, thereby the state of the switching mechanism 170 being changed from the first state to the second state.

Further, the lever 178 pushed by the carriage 23 and moving toward the first position moves rightward against the urging force of the spring 180, and engages with a third engaging member located on the right side with respect to the second engaging member. With this configuration, the slide member 171 moves rightward by the urging force of the spring 179 and following the movement of the lever 178. As a result, the state of the switching mechanism 170 is changed from the first state (see FIG. 5A) or the second state (see FIG. 5B) to the third state.

The switching mechanism 170 is in the first driving state (see FIG. 5A) when the carriage 23 is spaced from the lever 177. The lever 177, which is pushed rightward by the carriage 23, moves rightward against the urging force of the spring 179. With this movement, the slidable member 171 moves rightward, with following movement of the lever 177, by the urging force of the spring 178. As a result, the switching mechanism 170 changes its state from the first state (see FIG. 5A) to the second state (see FIG. 5B).

Thereafter, the lever 178 is further pushed by the carriage 23 which further moves rightward from the first position, and then the carriage 23 moves rightward and is separated from the lever 178. At this stage, the engagement between the lever 178 and the third engaging member is released. Then, the slide member 171 and the lever 178 are moved leftward by the urging force of the spring 180, and the lever 178 engages with the first engaging member. As a result, the switching mechanism changes it state from the third state (see FIG. 5C) to the first state (see FIG. 5A). That is, as the carriage 23, which moves from the first position toward the second position, is separated from the lever 178, the state of the switching mechanism 170 is changed from the third state to the first state.

That is, the state of the switching mechanism 170 is switched by contact/separation of the carriage 23 with respect to the lever 178. In other words, destinations to which the driving forces of the feeding motor 101 and the conveying motor 102 are transmitted are switched by the carriage 23. It is noted that, according to the illustrative embodiment, the state of the switching mechanism 170 cannot be switched directly from the third state to the second state. That is, in order to switch the state of the switching mechanism 170 from the third state to the second state, it must be switched from the third state to the first state, and then from the first state to the second state.

<Power Source>

The MFP 10 has a power source 110 as shown in FIG. 6. Power of an external power source is supplied, typically through a power plug, to the power source 110, which supplies power to respective components of the MFP 10. For example, the power source 110 supplies the power obtained from the external power source to each of the motors 101-103 and the inkjet head 39 as driving powers (e.g., 24 volts), and to a controller 130 as a control power (e.g., 5 volts). It is noted that, in FIG. 6, only an arrow extending from the power source 110 to the recording 39 is representatively shown to avoid the drawings from being complicated.

The power source 110 is configured to selectively operate in a driving state and a sleeping state based on a power control signal supplied from the controller 130. According to the illustrative embodiment, when the controller 130 supplies a high level power control signal (e.g., 5 volts) to the power source 110, the operating state of the power source 110 is switched to the sleeping state to the driving state.

Further, when the controller 130 supplies a low level power control signal (e.g., 0 volt) to the power source 110, the operating state of the power source 110 is switched to the driving state to the sleeping state.

It is noted that the driving state is a state in which the power source 110 is supplying the power to the motors 101-103 and the inkjet head 39. In other words, when the power source 110 is in the driving state, the motors 101-103 and the inkjet head 39 are ready to operate. In contrast, the sleeping state is a state in which the power source 110 supplies the power to none of the motors 101-103 and the inkjet head 39. In other words, when the power source 110 operates in the sleeping state, none of the motors 101-103 and the inkjet head 39 is ready to operate. Although not shown in the drawings, the power source 110 is configured to keep supplying the control power to the controller 30 and the communication device 50 regardless whether the power source 110 operates in the driving mode or the sleeping mode.

<Controller>

The controller 130 has a CPU (central processing unit) 131, a ROM (read only memory) 132, a RAM (random access memory) 133, EEPROM (electrically erasable programmable ROM) 134 and ASIC (application specific integrated circuit) 135, which are interconnected via a bus 137, as shown in FIG. 6. The ROM 132 stores programs to be executed by the CPU 131 to control operations of the MFP 10. The RAM 133 is used as a storage area in which the CPU 131 temporarily stores data, signals and the like when the CPU 131 executes respective programs stored in the ROM 132. The RAM 133 is also used as a work area when the CPU 131 processes data. The EEPROM 134 stores setting information and the like which should be retained after the MFP 10 is powered off.

The ASIC 135 is connected with the feeding motor 101, the conveying motor 102, and the carriage motor 103. The ASIC 135 generates driving signals to rotate respective motors, and controls the motors based on the driving signal, respectively. Each motor is configured to forwardly or reversely in accordance with the driving signal transmitted from the ASIC 135. The controller 130 is configured to control the power source 110 to apply the driving voltage to driving elements of the inkjet head 39 so that the ink droplets are ejected through the nozzles 40.

It is noted that the ASIC 135 is connected with the communication device 50. The communication device 50 is an interface which is communicatable with the information processing device 51. That is, the controller 130 is configured to transmit/receive information to/from the information processing device 51 through the communication device 50. The communication device 50 may be, for example, a device capable of transmitting/receiving wireless signals in accordance with a communication protocol based on the Wi-Fi standard, or an interface to which a LAN cable or a USB cable is connected. It is noted that, in FIG. 6, the information processing device 51 is circled with broken lines to indicate that the image processing device 51 is not a component of the MFP 10.

Further, the ASIC 135 is connected with the registration sensor 120, the rotary encoder 121, the carriage sensor 38, and the cap sensor 122. The controller 130 detects the position of the sheet 12 based on the detection signal transmitted from the registration sensor 120 and the pulse signal transmitted from the rotary encoder 121. Further, the controller 130 detects the position of the carriage 23 based on the pulse signal transmitted from the carriage sensor 38. Furthermore, the controller 130 detects the position of the cap 71 based on the detection signal transmitted from the cap sensor 122.

<Image Recording Process>

Hereinafter, an image recording process will be described referring to FIGS. 7-9. The image recording process is started in response to receipt of a command from the information processing device 51 through the communication device 50. It is assumed that, at a point of time when the image recording process is started, the carriage is located at the first position, the cap 71 is located at the covered position and the switching mechanism 170 operate in the third state. It is noted that respective processes described below may be executed as the CPU 131 retrieves programs stored in the ROM 132, or realized by hardware circuits implemented to the controller 130. Further, an execution order of respective processes may be changed within such a range as not change the scope of the present disclosures.

Although not shown in the drawings, the information processing device 51 is configured to, for example, transmits a preceding command to the MFP 10 in response to receipt of an instruction to cause the MFP 10 to execute the image recording process from the user. The preceding command is a command which notifies transmission of a recording command in advance. Next, in response to transmission of the preceding command, the information processing device 51 converts the image data designated by the user to raster data. Then, in response to generation of the raster data, the image processing device 51 transmits the recording command to the MFP 10. The recording command is a command causing the MFP 10 to record an image represented by the raster data on the sheet.

The controller 130 executes a first preparatory process in response to receipt of the preceding command from the information processing device 50 through the communication device 50 (S11: preceding command). That is, the preceding command can be regarded as a command instructing execution of the first preparatory process. The first preparatory process is a process to bring the printer 11 in condition for executing the recording process. It is noted that the "condition for executing the recording process" is, for example, a condition in which an image could be recorded with a particular or higher quality. According to the illustrative embodiment, the first preparatory process includes, as shown in FIG. 8, a voltage boosting process (S21), a separating process (S22), a first moving process and a first switching process (S23), and quick reciprocating processes (S24 and S25).

The voltage boosting process (S21) is a process to raise the driving voltage, which the power source 110 supplies to each component of the printer 11 up to a target voltage VT. The power source 110 serves, for example to raise a source voltage supplied from the external power source to the target voltage VT with use of a well-known boosting circuit. Boosting of the voltage means, for example, electrical energy is stored in a choke coil or condenser (not shown). It is noted that, if the driving voltage is raised too quickly, there is a possibility that the voltage being raised becomes unstable.

Therefore, according to the embodiment, a feedback control is employed to raise the driving voltage to a checking voltage V1 in the voltage boosting process. Then, in response to the driving voltage having been reached to the checking voltage V1, the driving voltage is further raised to a next checking voltage V2, which is lower than the target voltage VT, with use of the feedback control (i.e., V1<V2<VT). As above, by raising the driving voltage gradually with multiple raising steps, unstable variation of the driving voltage during boosting can be suppressed.

It is noted that the voltage boosting process (S21) is typically executed at a timing when the MFP 10 is powered on, or the operating state of the power source 110 is switched from the sleeping state to the driving state. It is noted that, when the driving voltage supplied by the power source 110 has reached the target voltage VT, execution of the voltage boosting process (S21) may be omitted.

The separating process (S22) is a process to move the cap 71 from the covering position to the spaced position. The controller 130 rotates the feeding motor 101 by a particular amount in a particular direction. As the rotational driving force of the feeding motor 101 is transmitted to the lifting device for the cap 71, the cap 71 is moved from the covering position to the spaced position. Further, the detection signal output by the cap sensor 122 changes from the high level signal to the low level signal before the cap 71 reaches the spaced position, or during execution of the separating process.

The first moving process (S23) is a process to move the carriage 23, from which the cap 71 has been separated, from the first position to the second position. The first switching process (S23) is a process to switch the state of the switching mechanism 170 from the third state to the first state. That is, the controller 130 executes the first moving process and the first switching process simultaneously by moving the carriage 23 at the first position rightward, and thereafter moving the carriage 23 leftward until the carriage 23 reaches the second position. It is noted that the controller 130 may move the carriage 23 leftward at a low speed when S23 is to be executed, and then execute S23 in order to suppress that meniscus of the ink formed on each nozzle 40 of the inkjet head 39 from broken.

The quick reciprocation process (S24 and S25) is a process to reciprocate at least one of the feeding motor 101 and the conveying motor 102. Specifically, when the switching mechanism 170 is in the third state, the controller 130 reciprocates (i.e., rotates in forward/reverse directions) both of the feeding motor 101 and the conveying motor 102 (S24). With this control, a surface pressure between the driving gear 172 and the driven gear 176, and a surface pressure between the driving gear 173 and the driven gear 177 are released, engagements among respective gears are smoothly released.

Further, when the switching mechanism 170 is switched to be in the first state, the controller 130 quickly reciprocates the feeding motor 101 (S25). With this control, the driving gear 172 and the driven gear 174 can be smoothly engaged with each other. It is noted that only one of the quick reciprocation processes (S24 and S25) may be executed.

As shown in FIG. 8, the controller 130 executes S21 and S22 simultaneously at a timing when the preceding command is received. Further, the controller 130 starts executing S23 and S24 simultaneously. It is note that a start timing of S24 may be slightly after a start timing of S23, although FIG. 8 shows a case where S23 and S24 are started at the same timing.

It is noted that the controller 130 starts the process of S23 at a timing when the detection signal of the cap sensor 122 has changed from the high level signal to the low level signal. That is, the controller 130 starts executing S23 after S21 and S22 are started. Specifically, the controller 130 executes, within a process of S23, a process to move the carriage 23 leftward at a low speed, and a process to move the carriage 23 rightward from the first position in parallel with S22. Further, the controller 130 executes a process to move the carriage 23 leftward toward the second position after completion of S22.

Typically, the voltage boosting process has the longest execution time among the processes (S21-S25) included in the first preparatory process. Accordingly, the controller 130 executes the process of S21 simultaneously with each of steps S22-S25. In other words, the controller 130 is configured to starts each of steps S22-S25 at particular timings during execution of S21. Still in other words, each of steps S22-S25 is executed in parallel with S21.

The controller 130 determines whether the first preparatory process has completed (S13) in response to receipt of the recording command from the information processing device 51 through the communication device 50 (S11: recording command). It is noted that the recording command may be received before completion of the first preparatory process as shown in FIG. 8, or after completion of the first preparatory process as shown in FIG. 9. In response to determination that the first preparatory process has not completed (S13: NO), the controller 130 waits execution of the remaining process until the first preparatory process is completed.

Then, in response to determination that the first preparatory process has completed (S13: YES), the controller 130 starts executing the second preparatory process (S14). The second preparatory process is a process to bring the printer 11 in condition for executing the recording process and is not included in the first preparatory process. The second preparatory process includes, for example, a flushing process (S31), a second moving process (S32), a first conveying process (S33) and a cueing process (S34) as shown in FIG. 8.

The flushing process (S31) is a process to cause the inkjet head 39 to eject ink droplets toward the ink receiver 75. That is, the controller 130 is configured to apply the driving voltage of the power source 110, which is boosted up to the target voltage VT, to the driving elements to cause the inkjet head 39 of the carriage 23 located at the second position to eject the ink droplets. It is noted that a time period for executing the flushing process may be longer when an elapsed time since the inkjet head 39 ejects the ink droplets lastly.

That is, the controller 130 start measuring the elapsed time period when the inkjet head 39 ejects the ink droplets, and resets a measured time period at a time when the inkjet head 39 ejects the ink droplets again. It is noted that a trigger to start measuring the elapsed time period may be ejection of the ink droplets in the flushing process (S31), or the ink ejection in an ejecting process (S15) which will be described later. The controller 130 determines an execution time period of the flushing process based on the measured time period (S14). Then, the controller causes the inkjet head 39 to ejects the ink droplets for the determined execution time period.

The second moving process is a process to move the carriage 23 to a recording start position. That is, the controller 130 moves the carriage 23 from the second position to the recording start position. The recording start position is a position from which the carriage 23 starts moving in the main scanning direction in the ejecting process described later. The recording start position is indicated by the received recording command.

The first conveying process (S33) is a process to cause the feeder assembly 15A to feed the sheet 12 accommodated in the first feed tray 20 toward the conveying roller 54. The first conveying process is executed when the recording command indicates the first feed tray 20A as the feeding source of the sheets 12. The controller 130 causes the feeding motor 110 to rotate forwardly. Thereafter, when the detection signal of the registration sensor 120 is changed from the low level signal to the high level signal, the controller 130 lets the feeding motor 101 to further rotate by the particular rotating amount. As the rotational driving force of the feeding motor 101 is transmitted to the feeding roller 25A through the switching mechanism 170, the sheet 12 supported by the first feed tray 20A is conveyed to the conveying passage 65.

The cueing process (S34) is a process to cause the sheet conveying assembly to further convey the sheet 12, which has been conveyed and reached the conveying roller 54 during the first conveying process, in the conveying direction 16 to a position at which an initial area of the sheet 12 on which an image is initially recorded (hereinafter, occasionally referred to a recordation area) faces the inkjet head 39. The initial recording area of the sheet is indicated by the recording command. The controller 130 causes the conveying assembly to convey the sheet 12, which has been conveyed and reached conveying roller 54 during the first conveying process.

It is noted that the each of the processes S31-S34 included in the second preparatory process cannot be started until at least a part of a plurality of processes included in the first preparatory process has completed. For example, the flushing process cannot be started until the voltage boosting process, the separating process and the first moving process have completed. However, the flushing process can be started even through the quick reciprocation process has not completed. The first conveying process cannot be started until the first switching process and the quick reciprocation process have completed, but can be started even though the voltage boosting process or the first moving process has not completed. Further, the second moving process cannot be started until the flushing process has completed. Furthermore, the cueing process cannot be started until the first conveying process has completed.

Thus, in response to receipt of the recording command, completion of the voltage boosting process, separating process and the first moving process (S11: recording command; S13: YES), the controller 130 executes the flushing process. In response to complete of the flushing process, the controller executes the second moving process. Further, in response to receipt of the recording command and completion of the first switching process and the quick reciprocation process (S11: recording command; S13: YES), the controller executes the first conveying process. In response to completion of the first conveying process, the controller executes the cueing process. It is note that the flushing process and the second moving process which are sequentially executed in the illustrative embodiment may be executed in parallel. Similarly, the first conveying process and the cueing process, which are sequentially executed in the embodiment, may be executed in parallel.

As shown in FIGS. 8 and 9, timings at which the flushing process and the first conveying process start vary depending on a relationship between a timing at which the first preparatory process is completed and a timing at which the recording command is received. As shown in FIG. 8, when the recording command is received before completion of the first preparatory process, the controller 130 starts the flushing process and the first conveying process at different timings. In contrast, as shown in FIG. 9, when the recording command is received after completion of the first conveying process, the controller starts the flushing process and the first conveying process at the same timing.

When the recording command indicates the second feed tray 20B as the feeding source of the sheets 12, the second preparatory process is to be executed at a timing shown in FIG. 10. It is noted that the second preparatory process shown in FIG. 10 is different from the second preparatory process shown in FIG. 8 or 9 by including a second switching process (S41) and including a second feeding process (S42) instead of the first conveying process (S33).

Hereinafter, the second preparatory process shown in FIG. 10 will be described. It is noted that, in the following description regarding FIG. 10, configurations which are common between the process shown in FIGS. 8 and 9 and the process shown in FIG. 10 will be omitted for brevity.

The second switching process (S41) is a process to switch the state of the switching mechanism 170 from the first state to the second state. According to the illustrative embodiment, the controller 130 moves rightward the carriage 23 located at the second position so that the lever 178 engaged with the first engaging member engages with the second engaging member. It is noted that the controller 130 may execute the quick reciprocating process in association with execution of the second switching process. The second conveying process (S42) is a process to cause the feeder assembly 15B to feed the sheet 12 supported on the second feed tray 20B to a position at which the sheet 12 reaches the conveying roller 54. The second conveying process is substantially the same as the first conveying process except that the process is executed with the state of the switching mechanism 170 is the second state.

In FIG. 10, the controller 130 executes the second switching process in response to completion of the flushing process, and executes the second moving process in response to completion of the second switching process. Further, the controller 130 execute the second conveying process in response to completion of the second switching process, and executes the cueing process in response to completion of the second conveying process. It is noted that, in FIG. 10, when the recording command is received after completion of the first preparatory process, substantially the same process is executed except that the start timing of the flushing process is deferred to a timing at which the recording command is received.

The controller 130 executes the recording process in accordance with the received recording command (S15-S18) in response to completion of all the processes included in the second preparatory process. The recording process includes, for example, alternately executed ejecting process (S15), conveying process (S17) and discharging process (S18). The ejecting process (S15) is a process to cause the inkjet head 39 to eject ink droplets toward the recordation area of the sheet 12 facing the inkjet head 39. The conveying process (S17) is a process to cause the conveying assembly to convey the sheet 12 by a particular conveying length in the conveying direction 16.

That is, the controller 130 moves the carriage 23 from one end to the other end of the sheet facing area with causing the inkjet head 39 to eject ink droplets at timings indicated by the recording command (S16). Next, in response to existence of an image to be recorded on the next recording area (S16: NO), the controller 130 causes the conveying assembly to convey the sheet 12 to a position where the next recording area faces the inkjet head 39 (S17). Until images are recorded on all the recording areas (S16: NO), the controller 130 repeatedly executes the process of S15-S17. Finally, in response to recordation of the images on all the recording areas (S16: YES), the controller casus the discharging roller 55 to discharge the sheet 12 onto the discharge tray 21 (S18).

Although not shown in the drawings, in response to elapse of a particular period of time after completion of the recording process (S15-S18), the controller 130 moves the carriage to the first position, changes the state of the switching mechanism 170 to the third state and moves the cap 71 to the covering position. It is noted that the controller 130 may further execute the quick reciprocation process in association with the above processes after completion of the recording process (S15-S18).

According to the above-described illustrative embodiment, the first preparatory process is executed as the preceding command is regarded as a trigger. Accordingly, in comparison with a configuration where the first preparatory process is executed after receipt of the recording command, FPOT can be shortened. Further, in the first preparatory process, the separating process, the first moving process, the first switching process and the quick reciprocation process are executed in parallel with the voltage boosting process. Accordingly, in comparison with a case where such processes are executed sequentially, the execution time period of the first preparatory process can be shortened.

According to the illustrative embodiment, since the flushing process is executed after the recording command is received, it is possible to shorten the waiting time period from completion of the flushing process to start of the recording process. Thus, deterioration of the image recording quality due to drying of the ink in the nozzles can be suppressed. As above, by executing the first preparatory process and the second preparatory process at appropriate timings, FPOT can be shortened, and further deterioration of the image recording quality can be suppressed.

At the point of time when the processes of S21-S23 have completed, in response to the measured elapsed time being equal to or greater than a particular threshold, the controller 130 may be configured to start the flushing process regardless whether the recording command is received or not. Further, at the point of time when the processes of S21-S23 have completed, in response to the measured elapsed time being less than a particular threshold, the controller 130 may start the flushing process at the timing according to the above-described embodiment. With this control, the flushing process of which execution time is relatively long, can be executed without waiting for the recording command, and the FPOT can be shortened.

According to the illustrative embodiment, the conveying process (S33, S42) is executed after receipt of the recording command. As a result, the sheets 12 are fed from the feed tray 20A or 20B designated in the recording command. Therefore, images can be recorded on appropriate sheets 12. It is noted that, if the MFP 10 has only one feed tray, the conveying process may be executed in response to completion of the quick reciprocation process, regardless whether the recording command is received.

What is claimed is:

1. An inkjet printing apparatus, comprising:

a sheet conveyer configured to convey a sheet in a conveying direction;

a carriage configured to move in a main scanning direction which intersect with the conveying direction in an area including a sheet facing area within which the carriage faces the sheet conveyed by the sheet conveyer;

an inkjet head mounted on the carriage and configured to eject ink droplets through nozzles formed on the inkjet head;

a cap configured to face the inkjet head when the carriage is located at a first position which is outside the sheet facing area in the main scanning direction, the cap being movable between a covering position and a spaced position, the covering position being a position at which the cap closely contacts the inkjet head and covers the nozzles, the spaced position being a position at which the cap is spaced from the inkjet head;

an ink receiver configured to face the inkjet head when the ink receiver is located at a second position which is outside the sheet facing area in the main scanning direction and different from the first position;

a communication device; and a controller, wherein the controller is configured to:

in response to receipt of a preceding command which is a command notifying transmission of a recording command in advance from an information processing device through the communication device, separate the cap from the covering position to the spaced position and a moving process move the carriage from which the cap is spaced from the first position to the second position; and in response to receipt of the recording command which instructs recording of an image on the sheet through the communication device and upon completion of moving the carriage to the second position, cause the inkjet head to eject the ink toward the ink receiver and cause the conveyer to convey the sheet and cause the inkjet head to eject the ink in accordance with the recording command.

2. The inkjet printing apparatus according to claim 1, further comprising a power source configured to apply a driving voltage causing the inkjet head to eject ink droplets from the nozzles, wherein the controller is further configured to:

in response to reception of the preceding command from the information processing device through the communication device, boost the driving voltage to a target voltage;

move the carriage to the second position and separate the cap from the covering position to the spaced position in parallel with the voltage boosting process;

receive the recording command from the information processing device through the communication device; and cause the inkjet head to eject the ink toward the ink receiver in response to completion of moving the carriage to the second position and boosting the driving voltage to the target voltage.

3. The inkjet printing apparatus according to claim 2, further comprising:

a first tray configured to support the sheets;

a second tray configured to support the sheets;

a first conveying roller configured to feed each of the sheet supported by the first tray toward the sheet conveyer;

a second conveying roller configured to feed each of the sheets supported by the second tray;

a lifting mechanism configured to elevate/descend the cap between the covering position and the spaced position;

a motor; and a switching mechanism configured to switch an operating state of the switching mechanism among a first state to rotate the first conveying roller, a second state to rotate the second conveying roller and a third state to drive the lifting mechanism, wherein the recording command indicates one of the first tray and the second tray, wherein the controller is further configured to execute:

switching the operating state of the switching mechanism from the third state to the first state in response to receipt of the preceding command from the information processing device through the communication device; and causing the first conveying roller to convey the sheet supported by the first tray until the sheet reaches the sheet conveyer in response to receipt of the recording command indicating the first tray from the information processing device through the communication device and completion of switching the operating state from the third state to the first state;

wherein causing the inkjet head to eject the ink in accordance with the recording command is performed in response to completion of causing the inkjet head to eject the ink toward the ink receiver and causing the first conveying roller to convey the sheet supported by the first tray until the sheet reaches the sheet conveyer.

4. The inkjet printing apparatus according to claim 1, further comprising:

a first tray configured to support the sheets;

a second tray configured to support the sheets;

a first conveying roller configured to feed each of the sheet supported by the first tray toward the sheet conveyer;

a second conveying roller configured to feed each of the sheets supported by the second tray;

a lifting mechanism configured to elevate/descend the cap between the covering position and the spaced position;

a motor; and a switching mechanism configured to switch an operating state of the switching mechanism among a first state to rotate the first conveying roller, a second state to rotate the second conveying roller and a third state to drive the lifting mechanism, wherein the recording command indicates one of the first tray and the second tray, wherein the controller is further configured to execute:

switching the operating state of the switching mechanism from the third state to the first state in response to receipt of the preceding command from the information processing device through the communication device; and causing the first conveying roller to convey the sheet supported by the first tray until the sheet reaches the sheet conveyer in response to receipt of the recording command indicating the first tray from the information processing device through the communication device and completion of switching the operating state of the switching mechanism from the third state to the first state;

wherein causing the inkjet head to eject the ink in accordance with the recording command is performed in response to completion of causing the inkjet head to eject the ink toward the ink receiver and causing the first conveying roller to convey the sheet supported by the first tray until the sheet reaches the sheet conveyer.

5. The inkjet printing apparatus according to claim 4, wherein the controller is further configured to execute:

switching process to switch mechanism from the first state to the second state and causing the second conveying roller to convey the sheet supported by the second tray until the sheet reaches the sheet conveyer in response to receipt of the recording command indicating the second tray from the information processing device through the communication device and completion of switching the operating state of the switching mechanism from the third state to the first state and causing the inkjet head to eject the ink toward the ink receiver;

wherein causing the inkjet head to eject the ink in accordance with the recording command is performed in response to completion of conveying the sheet via the second conveying roller until the sheet reaches the sheet conveyer.

6. An inkjet printing apparatus, comprising:

a sheet conveyer configured to convey a sheet in a conveying direction;

a carriage configured to move in a main scanning direction which intersect with the conveying direction in an area including a sheet facing area within which the carriage faces the sheet conveyed by the sheet conveyer;

an inkjet head mounted on the carriage and configured to eject ink droplets through nozzles formed on the inkjet head;

a cap configured to face the inkjet head when the carriage is located at a first position which is outside the sheet facing area in the main scanning direction, the cap being movable between a covering position and a spaced position, the covering position being a position at which the cap closely contacts the inkjet head and covers the nozzles, the spaced position being a position at which the cap is spaced from the inkjet head;

an ink receiver configured to face the inkjet head when the ink receiver is located at a second position which is outside the sheet facing area in the main scanning direction and different from the first position;

a first tray configured to support the sheets;

a second tray configured to support the sheets;

a first conveying roller configured to feed each of the sheet supported by the first tray toward the sheet conveyer;

a second conveying roller configured to feed each of the sheets supported by the second tray;

a lifting mechanism configured to elevate/descend the cap between the covering position and the spaced position;

a motor; and a switching mechanism configured to switch an operating state of the switching mechanism among a first state to rotate the first conveying roller, a second state to rotate the second conveying roller and a third state to drive the lifting mechanism, a communication device; and a controller, wherein, in response to receipt of a preceding command which is a command notifying transmission of a recording command in advance from an information processing device through the communication device, the controller is configured to execute:

a separating process to move the cap from the covering position to the spaced position;

a moving process to move the carriage from which the cap is spaced from the first position to the second position;

a flushing process to cause the inkjet head to eject the ink toward the ink receiver in response to receipt of the recording command which instructs recording of an image on the sheet through the communication device and upon completion of the moving process; and a recording process to cause the conveyer to convey the sheet and cause the inkjet head to eject the ink in accordance with the recording command, in response to completion of the flushing process;

wherein the recording command indicates one of the first tray and the second tray, wherein the controller is further configured to execute:

a first switching process to switch the operating state of the switching mechanism from the third state to the first state in response to receipt of the preceding command from the information processing device through the communication device;

a first conveying process to cause the first conveying roller to convey the sheet supported by the first tray until the sheet reaches the sheet conveyer in response to receipt of the recording command indicating the first tray from the information processing device through the communication device and completion of the first switching process; and the recording process in response to completion of the flushing process and the first conveying process;

wherein the recording command indicates an area on the sheet on which an image is initially printed, and wherein the controller is further configured to execute:

a cueing process to cause the sheet conveyer to convey the sheet in the conveying direction until the area indicated by the recording command reaches a position at which the area could face the inkjet head in response to completion of one of the first conveying process and the second conveying process, and the recording process in response to completion of the cueing process.

7. The inkjet printing apparatus according to claim 6, wherein the switching mechanism comprises:

a driving gear configured to be movable among multiple positions which are spaced in the main scanning direction depending on the operation state of the switching mechanism, the driving gear being rotated by the motor;

a first driven gear configured to engage with the driving gear in the first state to transmit a rotational force of the motor to the first conveying roller;

a second driven gear configured to engage with the driving gear in the second state to transmit the rotational force of the motor to the second conveying roller; and a third driven gear configured to engage with the driving gear in the third state to transmit the rotational force of the motor to the lifting mechanism, wherein the controller is further configured to execute a quick reciprocation to rotate the motor in both forward and reverse directions repeatedly.

8. An inkjet printing apparatus, comprising:

a sheet conveyer configured to convey a sheet in a conveying direction;

a carriage configured to move in a main scanning direction which intersect with the conveying direction in an area including a sheet facing area within which the carriage faces the sheet conveyed by the sheet conveyer;

an inkjet head mounted on the carriage and configured to eject ink droplets through nozzles formed on the inkjet head;

a cap configured to face the inkjet head when the carriage is located at a first position which is outside the sheet facing area in the main scanning direction, the cap being movable between a covering position and a spaced position, the covering position being a position at which the cap closely contacts the inkjet head and covers the nozzles, the spaced position being a position at which the cap is spaced from the inkjet head;

an ink receiver configured to face the inkjet head when the ink receiver is located at a second position which is outside the sheet facing area in the main scanning direction and different from the first position;

a first tray configured to support the sheets;

a second tray configured to support the sheets;

a first conveying roller configured to feed each of the sheet supported by the first tray toward the sheet conveyer;

a second conveying roller configured to feed each of the sheets supported by the second tray;

a lifting mechanism configured to elevate/descend the cap between the covering position and the spaced position;

a motor; and a switching mechanism configured to switch an operating state of the switching mechanism among a first state to rotate the first conveying roller, a second state to rotate the second conveying roller and a third state to drive the lifting mechanism, a communication device; and a controller, wherein, in response to receipt of a preceding command which is a command notifying transmission of a recording command in advance from an information processing device through the communication device, the controller is configured to execute:

a separating process to move the cap from the covering position to the spaced position;

a moving process to move the carriage from which the cap is spaced from the first position to the second position;

a flushing process to cause the inkjet head to eject the ink toward the ink receiver in response to receipt of the recording command which instructs recording of an image on the sheet through the communication device and upon completion of the moving process; and a recording process to cause the conveyer to convey the sheet and cause the inkjet head to eject the ink in accordance with the recording command, in response to completion of the flushing process;

wherein the recording command indicates one of the first tray and the second tray, wherein the controller is further configured to execute:

a first switching process to switch the operating state of the switching mechanism from the third state to the first state in response to receipt of the preceding command from the information processing device through the communication device;

a first conveying process to cause the first conveying roller to convey the sheet supported by the first tray until the sheet reaches the sheet conveyer in response to receipt of the recording command indicating the first tray from the information processing device through the communication device and completion of the first switching process; and the recording process in response to completion of the flushing process and the first conveying process;

wherein the switching mechanism comprises:

a driving gear configured to be movable among multiple positions which are spaced in the main scanning direction depending on the operation state of the switching mechanism, the driving gear being rotated by the motor;

a first driven gear configured to engage with the driving gear in the first state to transmit a rotational force of the motor to the first conveying roller;

a second driven gear configured to engage with the driving gear in the second state to transmit the rotational force of the motor to the second conveying roller; and a third driven gear configured to engage with the driving gear in the third state to transmit the rotational force of the motor to the lifting mechanism, wherein the controller is further configured to execute a quick reciprocation to rotate the motor in both forward and reverse directions repeatedly.

9. The inkjet printing apparatus according to claim 8, wherein the switching mechanism further comprises a sliding member configured to slide in the main scanning direction to switch the operating state of the switching mechanism as the carriage contacts or is released from the sliding member, wherein the sliding member is configured to switch the operating state of the switching mechanism:

to the third state as contacted by the carriage moving to the first position;

from the third state to the first state as the carriage moves from the first position to the second position and is released from the sliding member; and from the first state to the second state as contacted by the carriage moving from the second position toward the first position.

10. The inkjet printing apparatus according to claim 1, wherein an execution period of causing the inkjet head to eject the ink toward the ink receiver is longer when an elapsed time since the inkjet head most recently ejects the ink is longer, wherein the controller is configured to start executing:

causing the inkjet head to eject the ink toward the ink receiver after receipt of the recording command in response to the elapsed time being less than a threshold value; and causing the inkjet head to eject the ink toward the ink receiver regardless whether recording command is received in response to the elapsed time being equal to or longer than the threshold value.

11. The inkjet printing apparatus according to claim 1, wherein the controller is configured to, in response to receipt of the preceding command, separate the cap from the covering position to the spaced position and move the carriage from which the cap is spaced from the first position to the second position without causing the inkjet head to eject the ink prior to receipt of the recording command.

12. The inkjet printing apparatus according to claim 1, wherein the controller is configured to cause the inkjet head to eject the ink toward the ink receiver after both moving the carriage from the first position to the second position is completed and receipt of the recording command occurs.

* * * * *